US009179527B2

(12) United States Patent
Yao et al.

(10) Patent No.: US 9,179,527 B2
(45) Date of Patent: Nov. 3, 2015

(54) PROGRAMMABLE LIGHT EMITTING DIODE (LED) DRIVER TECHNIQUE BASED UPON A PREFIX SIGNAL

(71) Applicant: General Electric Company, Schenectady, NY (US)

(72) Inventors: Gang Yao, Mayfield Heights, OH (US); Nina Scheidegger, East Cleveland, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 13/942,728

(22) Filed: Jul. 16, 2013

(65) Prior Publication Data

US 2015/0022119 A1 Jan. 22, 2015

(51) Int. Cl.
*H05B 37/02* (2006.01)
*H05B 33/08* (2006.01)

(52) U.S. Cl.
CPC ..... *H05B 37/0254* (2013.01); *H05B 33/0842* (2013.01)

(58) Field of Classification Search
USPC ..... 315/291, 360, 246
See application file for complete search history.

(56) References Cited

U.S. PATENT DOCUMENTS 4,680,701 A * 7/1987 Cochran ..... 712/40
6,376,851 B1 4/2002 Workey
6,411,074 B1 6/2002 Kruchowy et al.
7,126,288 B2 * 10/2006 Ribarich et al. ..... 315/308
7,818,519 B2 * 10/2010 Plunkett ..... 711/158
8,310,171 B2 11/2012 Reisenauer et al.
8,344,659 B2 * 1/2013 Shimomura et al. ..... 315/307
8,933,634 B2 1/2015 Williams et al.
2005/0156644 A1 7/2005 Karnahan et al.
2006/0279970 A1 12/2006 Kernahan
2007/0236158 A1 10/2007 Ball et al.
2008/0292342 A1 * 11/2008 Yamashita ..... 399/51
2009/0115435 A1 5/2009 Tomlinson
2009/0278522 A1 * 11/2009 Kernahan et al. ..... 323/299
2010/0072909 A1 * 3/2010 O'Gorman et al. ..... 315/246
2010/0118230 A1 * 5/2010 Murao ..... 349/65
2010/0156319 A1 6/2010 Melanson
2010/0171145 A1 * 7/2010 Morgan et al. ..... 257/99
2011/0080111 A1 4/2011 Nuhfer et al.
2012/0012736 A1 1/2012 Simony
2012/0061462 A1 * 3/2012 Shadwell et al. ..... 235/375
2013/0043810 A1 2/2013 McKinney et al.
2013/0063042 A1 3/2013 Bora et al.

(Continued)

OTHER PUBLICATIONS

International Search Report and Written Opinion issued in connection with corresponding WO Application No. PCT/US2014/044871 dated Oct. 23, 2014.

(Continued)

*Primary Examiner* — Douglas W Owens
*Assistant Examiner* — Syed M Kaiser
(74) *Attorney, Agent, or Firm* — GE Global Patent Operation; Peter T. DiMauro

(57) ABSTRACT

Provided is a light emitting diode (LED) driver. The LED driver includes a microcontroller for setting a level of an output current of the driver. The driver is configured to receive a prefix as an input, the prefix instructing the microcontroller to enter a programming mode. The microcontroller is responsive to a level signal representative of the level of the output current during the programming mode.

13 Claims, 7 Drawing Sheets

(56) References Cited

U.S. PATENT DOCUMENTS

| | | | | |
|---|---|---|---|---|
| 2013/0090869 | A1 | 4/2013 | Ewing et al. | |
| 2013/0158918 | A1 | 6/2013 | Spanier et al. | |
| 2013/0166616 | A1* | 6/2013 | Fasthuber et al. | 708/620 |
| 2013/0229123 | A1* | 9/2013 | Chen et al. | 315/201 |
| 2013/0233321 | A1 | 9/2013 | Singh | |
| 2014/0035481 | A1* | 2/2014 | Peting et al. | 315/291 |
| 2014/0103818 | A1 | 4/2014 | Chen | |
| 2014/0118877 | A1* | 5/2014 | Viele | 361/111 |
| 2014/0160091 | A1 | 6/2014 | Mann | |
| 2014/0254050 | A1 | 9/2014 | Haines | |
| 2014/0265897 | A1 | 9/2014 | Taipale et al. | |

OTHER PUBLICATIONS

PCT Search Report and Written Opinion issued in connection with related PCT Application No. PCT/US2014/046462 on Sep. 26, 2014.

Gang Yao et al., Jul. 16, 2013, U.S. Appl. No. 13/942,727.

* cited by examiner

500

PROGRAMMABLE LIGHT EMITTING DIODE (LED) DRIVER TECHNIQUE BASED UPON A PREFIX SIGNAL

I. FIELD OF THE INVENTION

The present invention relates generally to supplying power to LEDs. More particularly, the present invention relates to controlling the current supplied to an LED driver.

II. BACKGROUND OF THE INVENTION

LEDs are widely used in general lighting applications. As their use expands, LED designs become more flexible to accommodate their evolving lighting system applications. A fundamental component of an LED lighting system is an LED driver.

By way of background, LED drivers regulate the amount of electrical power applied to individual LEDs, or an LED array. LED drivers differ from traditional power supplies in that LED drivers vary the amount of power applied to the LED based upon the LEDs fluctuating needs.

For example, many LED lighting systems include dimming capabilities. Other LED lighting systems may have electrical and structural similarities, but may have completely different illumination intensity requirements. One way to provide a dimming capability and/or control the illumination intensity of the LED lighting system is to vary the output current of the LED driver.

To increase the flexibility of LED drivers, many drivers include programmable settings. These programmable LED driver settings enable a single LED driver design to support the requirements of different LED lighting systems or luminaires. In most LED driver circuits, programmability is provided through use of a microcontroller.

In conventional LED drivers, a popular programming technique is to transmit digital messages, via a programming interface, to the microcontroller. These digital messages include instructions to the microcontroller related to the output current level. That is, the microcontroller reads these digital messages and adjusts the driver's output current level accordingly.

The problem with these conventional approaches is that most LED driver circuits include mainly analog circuit components. As a result, the speed and accuracy of these digital messages can be distorted and/or diminished as the messages are transmitted between the programming interface, through the analog circuitry, and to the microcontroller.

III. SUMMARY OF EMBODIMENTS OF THE INVENTION

Given the aforementioned deficiencies, a need exists for efficient and accurate approaches to program LED drivers. More specifically, methods and systems are needed to more accurately program the output current level of LED drivers.

Embodiments of the present invention provide a light emitting diode (LED) driver. The LED driver includes a microcontroller for setting a level of an output current of the driver. The driver is configured to receive a prefix as an input, the prefix instructing the microcontroller to enter a programming mode. The microcontroller is responsive to a level signal representative of the level of the output current during the programming mode.

In one embodiment of the present invention, a programmable prefix is sent to the microcontroller within the LED driver using existing circuit dimming leads. The prefix sets the microcontroller to a programmable mode. By using the existing circuit dimming leads, the need and costs associated with adding extra wires can be eliminated. After receipt of the prefix, a level signal instructs the microcontroller to set an output current of the LED driver at a specified level.

In another embodiment, a negative voltage signal is provided as an input to the LED driver. An amplifier inverts the negative voltage into a positive voltage. When the microcontroller determines that the amplifier's output voltage is over a specified level, it transitions to output current programming mode, setting the output current in accordance with the positive voltage. By providing the aforementioned programmability features, a single LED driver can accurately and efficiently be used with different loads and different lighting fixtures and systems.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

IV. BRIEF DESCRIPTION OF THE DRAWINGS

The accompanying drawings, which are incorporated herein and form part of the specification, illustrate the present invention and, together with the description, further serve to explain the principles of the invention and to enable a person skilled in the relevant art(s) to make and use the invention.

V. DETAILED DESCRIPTION OF EMBODIMENTS OF THE INVENTION

While the present invention is described herein with illustrative embodiments for particular applications, it should be understood that the invention is not limited thereto. Those skilled in the art with access to the teachings provided herein will recognize additional modifications, applications, and embodiments within the scope thereof and additional fields in which the invention would be of significant utility.

Figure 1:
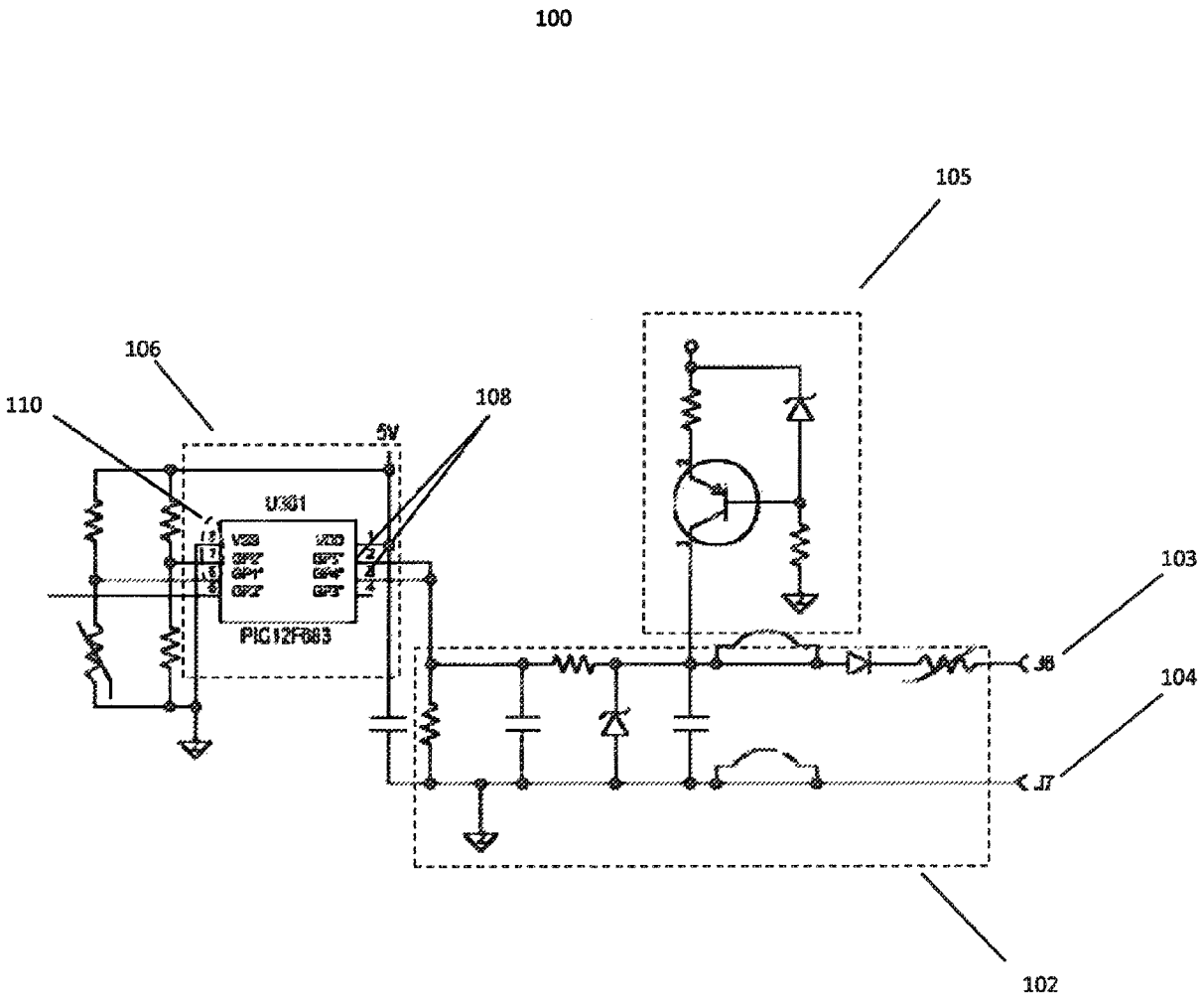
FIG. 1 is a schematic diagram representation of an exemplary LED driver in which a first embodiment of the present invention can be practiced.

FIG. 1 is a schematic diagram representation of an exemplary LED driver 100 in which a first embodiment of the present invention may be practiced. As discussed above, the LED driver 100 regulates the amount of electrical power applied to individual LEDs, or an LED array (not shown). In the LED driver 100, a standard 0-10V dimming lead, or digital addressable lighting interface (DALI) lead, is used to inject a prefix and program the output current. The output current is ultimately supplied to the LEDs, or LED array, to control dimming.

More specifically, the exemplary LED driver 100 includes an input and line conditioning segment 102, including standard existing 0-10V and/or DALI input terminals 103 and 104. Also included is a constant current source segment 105, along with a microcontroller segment 106. In the LED driver 100, a prefix signal, discussed more fully below, is provided at the input terminals 103 and 104 to notify the microcontroller 106 that the output current is about to be programmed.

Figure 2:
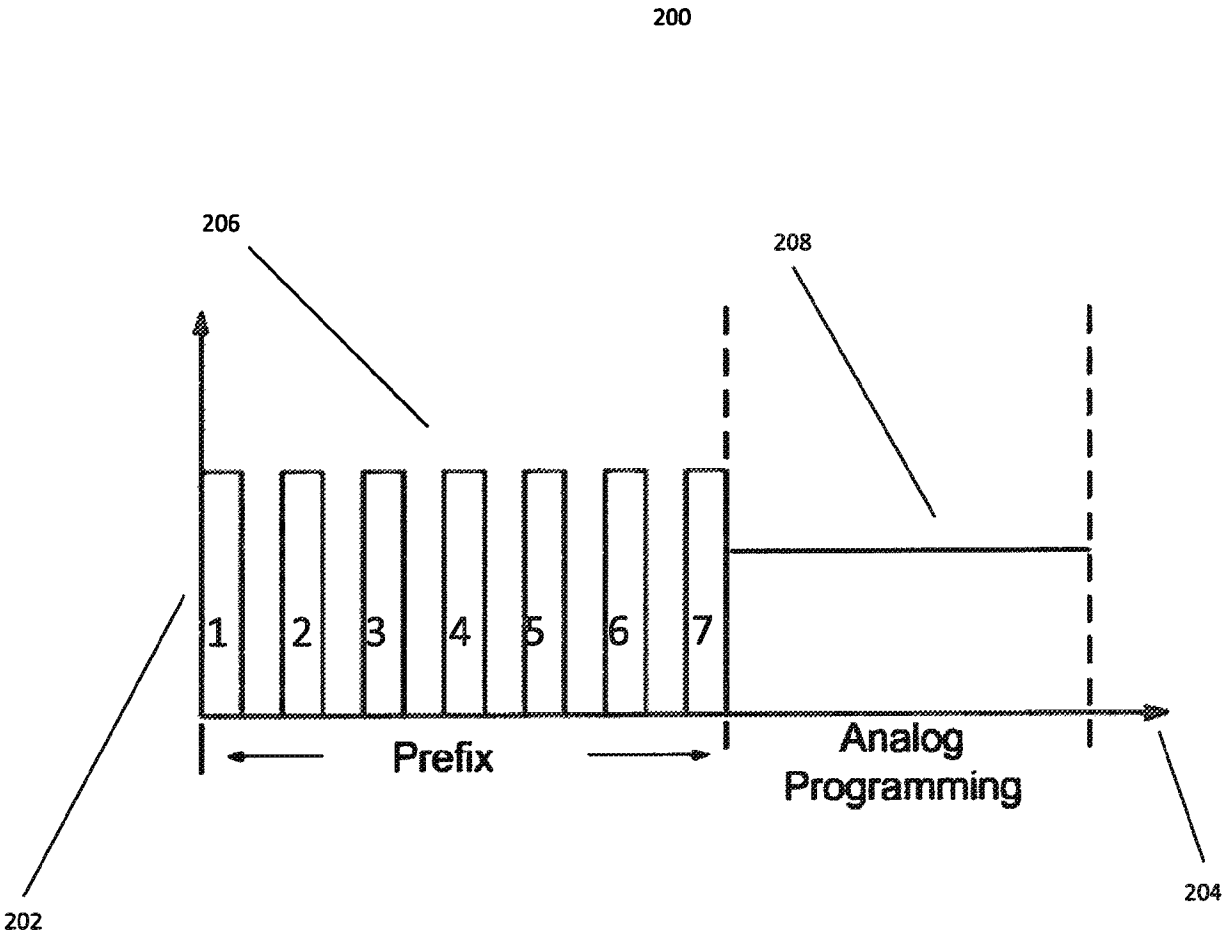
FIG. 2 is a graphical illustration of programming signals constructed in accordance with the first embodiment.

FIG. 2 is a graph 200 of programming signals constructed in accordance with an embodiment of the present invention. The graph 200 includes a magnitude axis 202 and a time axis 204. The graph 200 also depicts a prefix signal 206. In the example of FIG. 2, the prefix 206 is shown as a 7 bit code added to the beginning of an analog programming signal 208. In the embodiments, however, the prefix 206 is not limited to a 7 bit code and can be formed in accordance many different approaches.

Although the graph 200 depicts the analog programming signal 208 commencing immediately after the prefix 206, the analog programming signal 208 and the prefix 206 can be separated by an amount of time. For example, in some embodiments of the present invention the analog programming signal 208 and the prefix 206 can be separated by about 100 milliseconds (ms). In a specific exemplary embodiment, the prefix 206 and the programming signal 208 are separated by about 75 ms.

During an exemplary programming cycle, the prefix 206, and the programming signal 208 are provided as an inputs via the input terminals 103 and 104. At a factory, or during installation of a lighting system, a user employing a handheld device, or some other interface, can connect the device to the input terminals 103 and 104 for output current programming.

In example programming cycle above, the prefix 206, being treated as a passive input to the input and line conditioning segment 102, will be received at pins 108 of the microcontroller 106. The microcontroller 106 will read and interpret the prefix 206 as an instruction to enter an output current programming mode. After conclusion of the programming cycle, the microcontroller 106 will wait a predetermined amount of time, for example 20 ms, and cease programming operations. The microcontroller 106 will then wait for commencement of an ensuing programming cycle.

After entering the programming mode, the microcontroller 106 will read the analog programming signal 208. The analog programming signal 208 is a voltage signal, or message, that instructs the microcontroller 106 at what level to specifically set the output current. More specifically, the output current is programmed to be a function of the voltage level of the analog programming signal 208. By relying on the use of a prefix, as noted above, the embodiments reduce the reliance on the accuracy of sending digital messages through analog circuitry.

Figure 3:
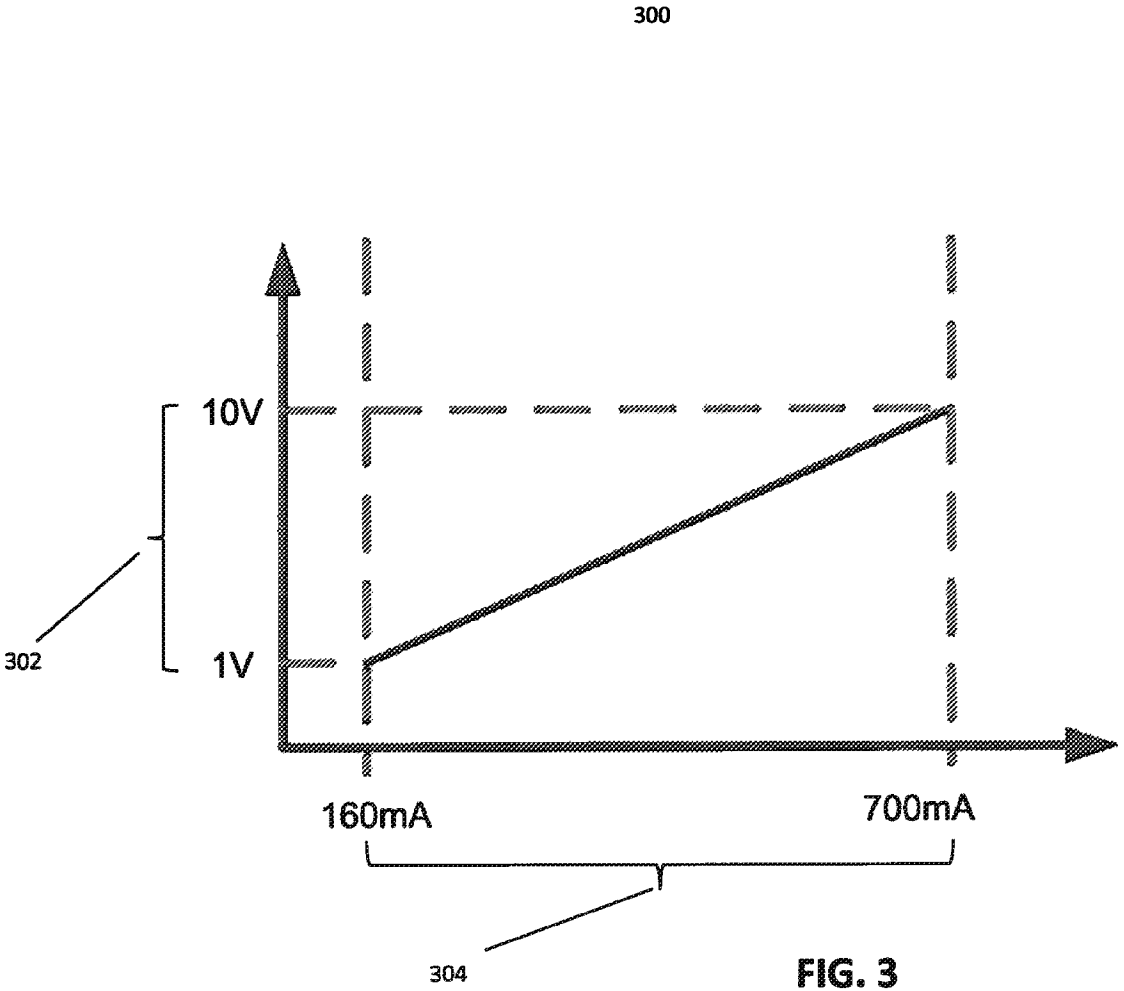
FIG. 3 is a graphical illustration of an exemplary current output in accordance with the first embodiment.

FIG. 3 is a graph 300 of an exemplary current output curve in accordance with the first embodiment. In the graph 300, for example, the analog programming signal 208 is shown to be within a range 302 of about 1-10 volts (V), although the present invention is not so limited.

In the example of FIG. 3, however, when the analog programming signal 208 is within the range 302, the microcontroller 106 sets the output current of the driver 100 to be within a range 304 of about 160-700 milli-amps (mA) via output terminals 110. The present invention, however, is not limited to the specific values depicted in the graph 300 as many other suitable values would be within the spirit and scope of the present invention.

Figure 4:
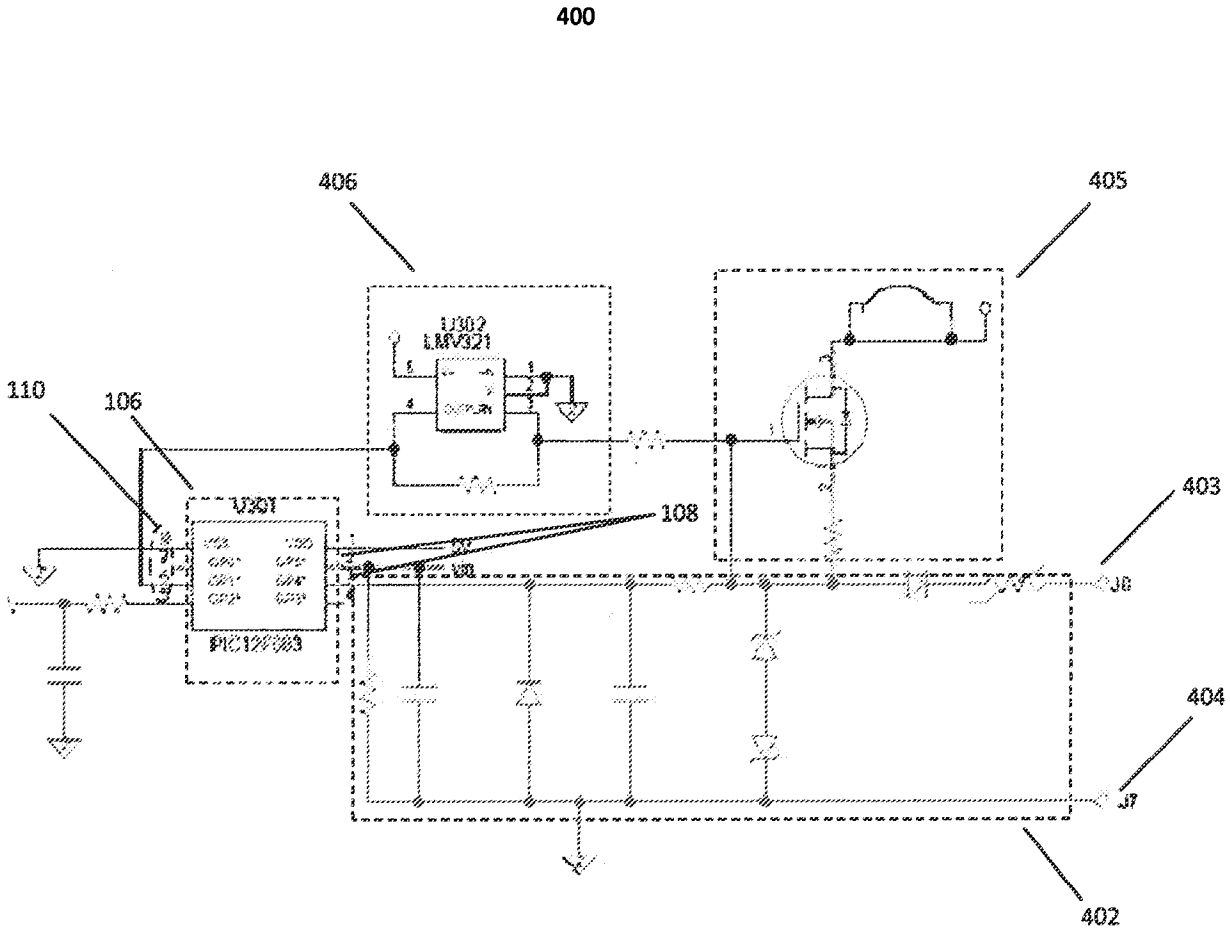
FIG. 4 is a schematic diagram representation of an exemplary LED driver in which a second embodiment of the present invention may be practiced.

FIG. 4 is a schematic diagram representation of an exemplary LED driver 400 in which a second embodiment of the present invention may be practiced. In the exemplary driver 400, a negative voltage is used, instead of a prefix, to instruct the microcontroller to program the output current at a specified level.

The LED driver 400 includes an input and line conditioning segment 402, including dimming input terminal leads 403 and 404. Also included is a constant current source segment 405, an amplifier segment 406, and the microcontroller segment 106 depicted above in the LED driver 100. Although specific part numbers are shown in association with the amplifier segment 406 and the microcontroller segment 106, the embodiments of the present invention are limited to these specific parts.

In the LED driver 400, and by way of example, a negative input voltage between (e.g., −11V to −14V) can be applied to the input terminals 403 and 404. This negative input voltage will trigger the programming of the microcontroller 106 to set the output current level. The embodiments of the present invention, however, are not limited to this, or other, voltage ranges used as examples herein.

When the negative input voltage signal is applied to the input terminals 403 and 404, the input and line conditioning segment 402 and a constant source segment 405 behave substantially passively with respect to the input voltage signal. The amplifier segment 406 will invert the negative input voltage signal to a positive voltage signal having an exemplary range, for example, of about 1-5V.

The microcontroller 106 monitors signals output from the amplifier segment 406. When the microcontroller 106 detects that a positive voltage signal output from the amplifier segment 406 has a value exceeding a threshold of about 1V, the microcontroller 106 enters the output current programming mode. More specifically, the microcontroller 106 will set the output current level of the LED driver 400 in accordance with a value of the positive voltage signal output from the amplifier segment 406.

Figure 5:
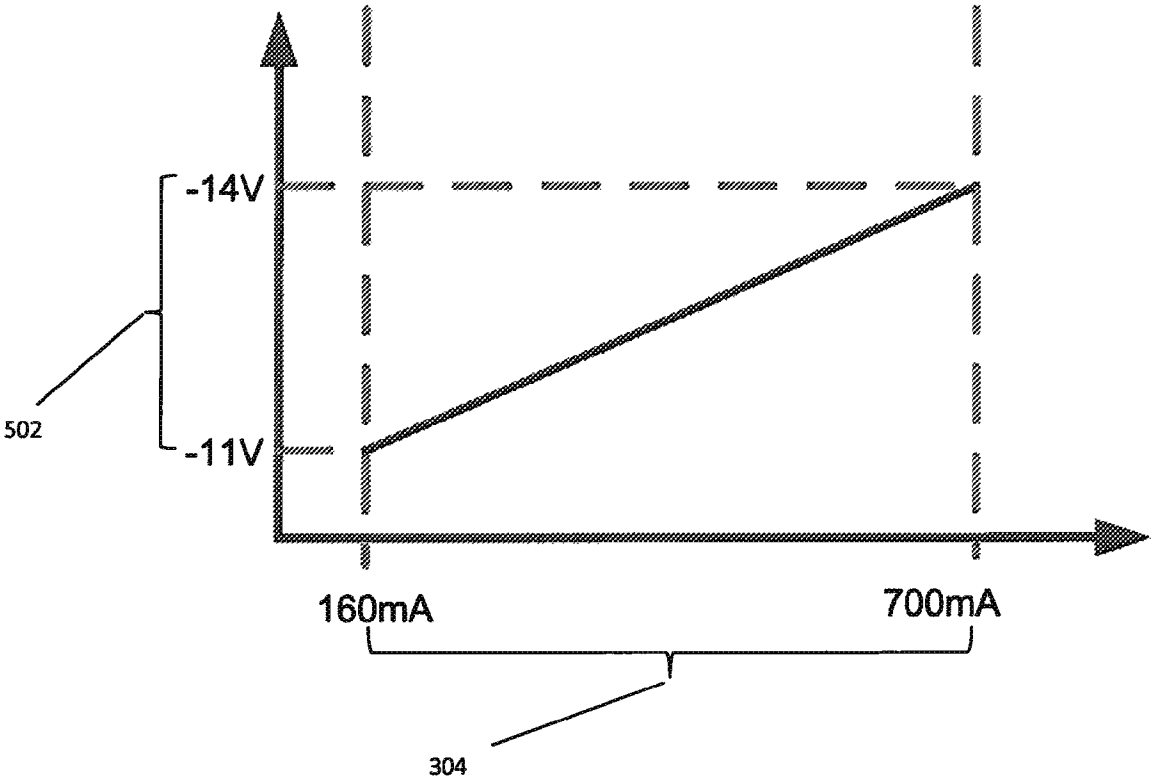
FIG. 5 is a graphical illustration of an exemplary current output in accordance with the second embodiment.

FIG. 5 is a graph 500 of an exemplary current output curve produced in accordance with the second embodiment. In the graph 500, a negative input voltage within a range 502 of about −11 to −14V will produce a corresponding output current within the range 304, for example, of about 160-170 mA. The instructions produced by the microcontroller 106 to set the output current within the range 304 can be provided, for example, at one or more of the output terminals 110 of the microcontroller 106.

Figure 6:
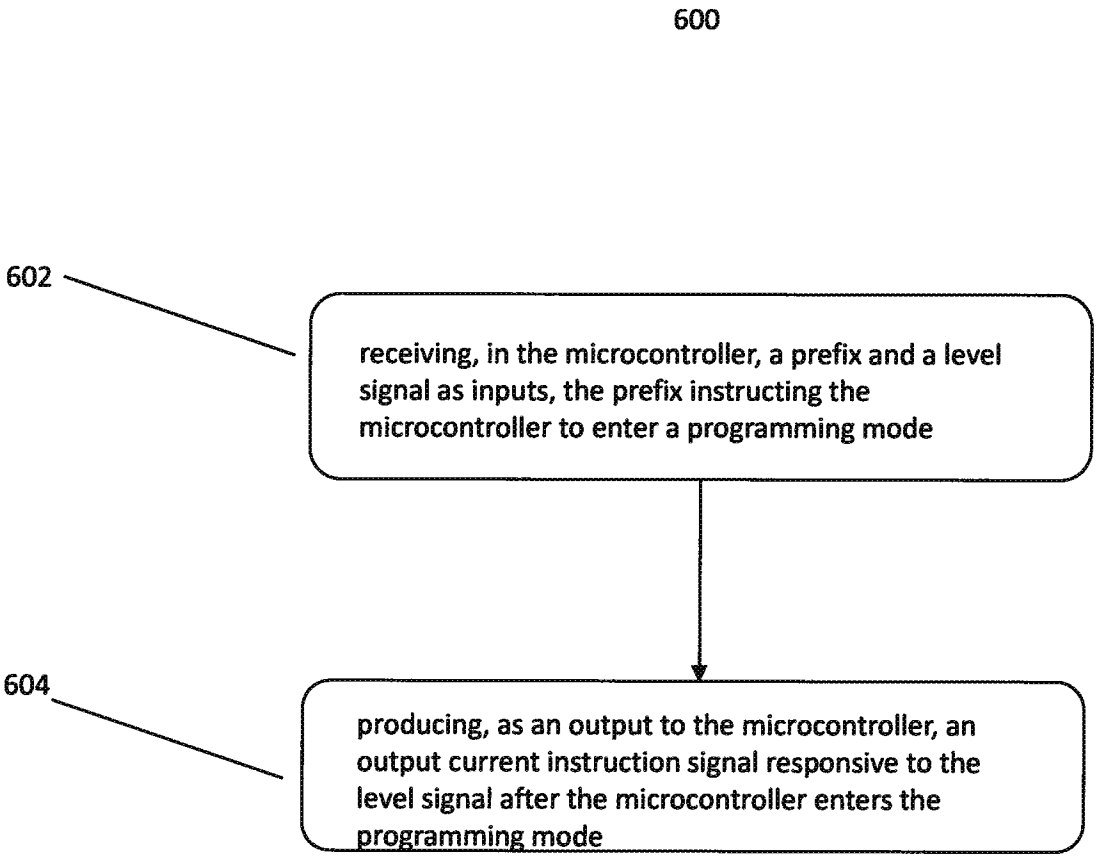
FIG. 6 is a flowchart of an exemplary method of practicing a first embodiment of the present invention.

FIG. 6 is a flowchart of an exemplary method 600 of practicing an embodiment of the present invention. In the exemplary method 600, the microcontroller 106 receives a prefix and level signal as inputs in step 602. The prefix instructs the microcontroller 106 to enter a programming mode. In step 604, the microcontroller produces an output current instruction signal responsive to the level signal after the microcontroller 106 enters the programming mode.

Figure 7:
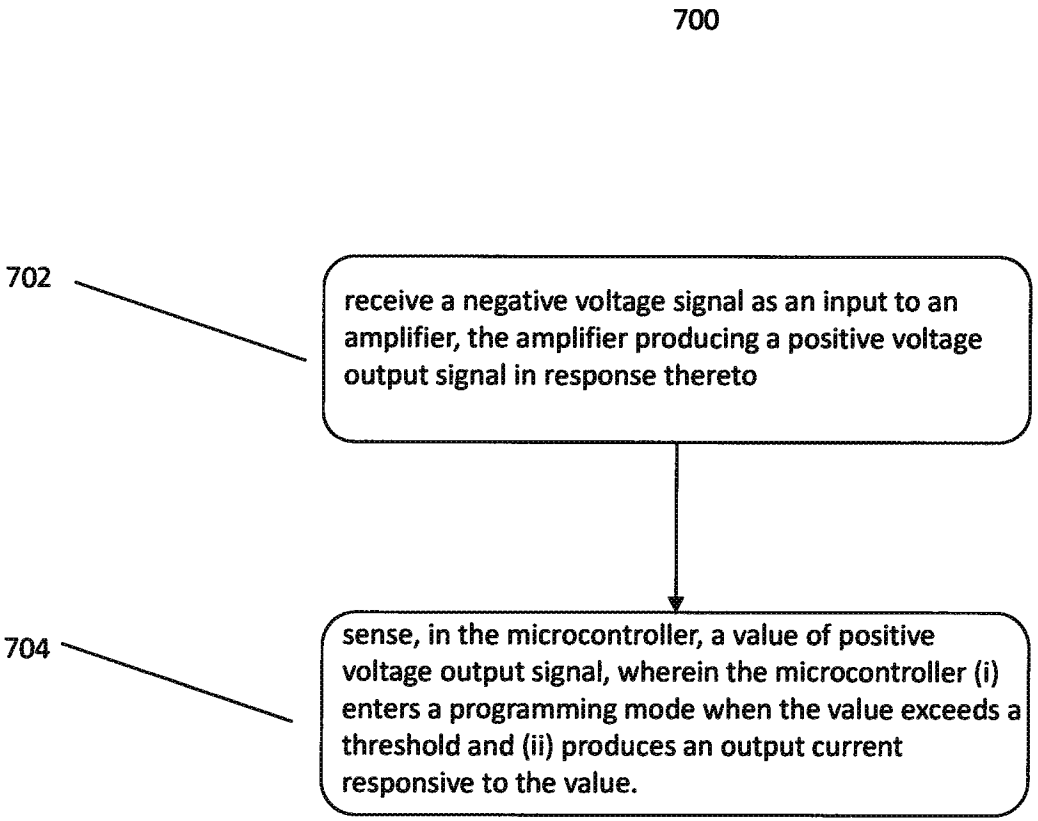
FIG. 7 is a flowchart of an exemplary method of practicing a second embodiment of the present invention.

FIG. 7 is a flowchart of an exemplary method 700 of practicing a second embodiment of the present invention. In the exemplary method 700, the amplifier segment 406 receives a negative input voltage signal as an input and produces a positive voltage output signal in response thereto in step 702. In step 704, the microcontroller 106 senses a value of the positive voltage output signal. The microcontroller 106 (i) enters a programming mode when the value exceeds a threshold and (ii) produces an output current responsive to the value.

CONCLUSION

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

For example, various aspects of the present invention can be implemented by software, firmware, hardware (or hardware represented by software such, as for example, Verilog or hardware description language instructions), or a combination thereof. After reading this description, it will become apparent to a person skilled in the relevant art how to implement the invention using other computer systems and/or computer architectures.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

What is claimed is:

1. A light emitting diode (LED) driver, comprising:

a microcontroller for setting a level of an output current of the driver;

wherein the microcontroller is configured to receive, within a programming cycle, an instruction signal including (i) a non-analog prefix signal segment instructing the microcontroller to enter an output current programming mode and (ii) an analog programming signal segment in sequence after the prefix signal segment; and wherein the analog programming signal segment is configured to set a level of the output current responsive to a magnitude of a voltage of the analog programming signal segment.

2. The LED driver of claim 1, wherein the analog programming signal segment signal instructs the microcontroller to set the output current at the level.

3. The LED driver of claim 1, wherein the microcontroller receives the analog programming signal segment within a predetermined amount of time after receiving the prefix signal segment.

4. The LED driver of claim 3, wherein the amount of time is programmable.

5. A method of programming a light emitting diode (LED) driver including a microcontroller configured to set a level of an output current of the driver, the method comprising:

receiving within a programming cycle, in the microcontroller, an instruction signal including (i) a non-analog prefix signal segment instructing the microcontroller to enter an output current programming mode and (ii) an analog programming signal segment in sequence after the prefix signal segment;

wherein the analog programming signal segment is configured to set a level of the output current responsive to a magnitude of the voltage of the analog programming signal segment.

6. The method of claim 5, wherein the analog programming signal segment instructs the microcontroller to set the output current level.

7. The method of claim 6, wherein the microcontroller receives the analog programming segment signal within a predetermined amount of time after the prefix signal segment.

8. The method of claim 7, wherein the amount of time is programmable.

9. A tangible computer readable media storing instructions wherein said instructions when executed are configured to execute processes within a computer system, with a method comprising:

receiving within a programming cycle, in the microcontroller, an instruction signal including (i) a non-analog prefix signal segment instructing the microcontroller to enter an output current programming mode and (ii) an analog programming signal segment in sequence after the prefix signal segment;

wherein the analog programming signal segment is configured to set a level of the output current responsive to a magnitude of the analog programming signal segment.

10. The tangible computer readable media of claim 9, wherein the analog programming signal segment instructs the microcontroller to set the output current level.

11. The tangible computer readable computer media of claim 10, wherein the microcontroller receives the analog programming signal segment within a predetermined amount of time after the prefix signal segment.

12. The tangible computer readable media of claim 11, wherein the amount of time is programmable.

13. The tangible computer readable media of claim 5, wherein the analog programming signal segment is appended to the prefix signal segment.

* * * * *